US005457876A

United States Patent [19]

Gerhard, Jr.

[11] Patent Number: 5,457,876

[45] Date of Patent: Oct. 17, 1995

[54] CONDUCTOR GUIDE MECHANISM IN A TOOL FOR TERMINATING CONDUCTORS OF A CABLE TO A CONNECTOR

[75] Inventor: George H. Gerhard, Jr., Laureldale, Pa.

[73] Assignee: The Whitaker Corporation, Wilmington, Del.

[21] Appl. No.: 405,580

[22] Filed: Mar. 16, 1995

Related U.S. Application Data

[63] Continuation of Ser. No. 169,033, Dec. 16, 1993, abandoned.

[51] Int. Cl.[6] ..... H01R 43/055; H01R 43/045

[52] U.S. Cl. ..... 29/751; 29/566.4; 29/753; 29/755; 29/759

[58] Field of Search ..... 29/33 M, 566.3, 29/566.4, 749, 750, 751, 753, 755, 759, 760, 861, 863, 866; 72/410, 469; 7/107

[56] References Cited

U.S. PATENT DOCUMENTS

| | | | |
|---|---|---|---|
| 4,110,896 | 9/1978 | Roiko | 29/749 X |
| 4,125,137 | 11/1978 | Shatto, Jr. | 29/749 X |
| 4,203,196 | 5/1980 | Fukushima et al. | 29/566.3 |
| 4,318,215 | 3/1982 | Holt | 29/751 X |
| 4,351,110 | 9/1982 | Folk | 29/861 X |
| 4,375,719 | 3/1983 | Kent | 29/759 X |
| 4,453,307 | 6/1984 | Casey | 29/759 X |
| 5,212,882 | 5/1993 | Hamonko et al. | 29/751 X |
| 5,410,803 | 5/1995 | Gerhard, Jr. | 29/753 |

FOREIGN PATENT DOCUMENTS

| | | | |
|---|---|---|---|
| 494750 | 7/1992 | European Pat. Off. | 29/755 |
| 2521515 | 12/1975 | Germany | 29/749 |
| 3430904 | 3/1986 | Germany | 29/755 |
| 1386277 | 3/1975 | United Kingdom | 29/749 |
| 2140715 | 12/1984 | United Kingdom | 29/755 |

OTHER PUBLICATIONS

IS 9359—AMP Terminating Head 58336-1 for AMP-MODU·MTE Connectors; Nov. 17, 1987, pp. 1–7.

*Primary Examiner*—Peter Vo

[57] ABSTRACT

A tool is disclosed for terminating conductors of a cable to insulation displacement contacts of terminals that are partially assembled to a connector housing. After termination of all of the terminals the assembly is removed from the tool and the entire strip of terminals is fully inserted into the connector housing and the carrier strip removed and discarded. The tool includes an insertion blade attached to a reciprocating ram for effecting the termination and a terminal strip feed mechanism. A comb mechanism is coupled to the insertion blade and interacts with camming surfaces fixed to the frame to engage and align the conductor between the insertion blade and the terminal by means of a combing action. The comb mechanism engages the conductor at a point away from the end thereof and then moves toward the end thereby moving the conductor into the desired alignment.

9 Claims, 10 Drawing Sheets

CONDUCTOR GUIDE MECHANISM IN A TOOL FOR TERMINATING CONDUCTORS OF A CABLE TO A CONNECTOR

This application is a Continuation of application Ser. No. 08/169,033, filed Dec. 16, 1993, now abandoned.

The present invention relates to tools for terminating the conductors of a cable to the terminals of a connector and more particularly to a mechanism for combing each conductor into alignment with the terminal for termination thereof.

BACKGROUND OF THE INVENTION

There is a need for small hand operated or simple bench mounted tools that may be efficiently used to terminate conductors to terminals of a connector on a small quantity basis. One such terminating tool is the Terminating Head part number 58336-1, manufactured by AMP Incorporated, Harrisburg, Pa. The tool is arranged to be attached to a standard pistol grip handle for manual actuation, an air powered handle, or may be mounted to a work bench along with an air power unit for power actuation. The tool, a front view of which is shown in FIG. 1 and identified as 10, is limited to terminating discrete wires only, however, the present invention is broadly applied to such tools that accommodate the conductors of ribbon cables as well as discrete wires. As is shown, the tool 10 includes a frame 12, a terminal strip guide 14, and an insertion mechanism 16 which is driven by a ram 18. A connector having a strip 20 of terminals partially assembled thereto is positioned within the frame so that the strip of terminals rests on a work surface of the guide 14 and the left most terminal is in alignment with the insertion blade. A discrete wire is inserted from the front of the tool into a U-shaped opening 22 so that it is between the insertion blade and the first terminal. The ram 18 is then caused to move downwardly, as viewed in FIG. 1, causing the wire to be pushed into the insulation displacement contact of the first terminal. A somewhat L-shaped feed arm 24 is pivotally attached to the frame 12 and moves a feed finger 28. After each insertion the arm 24 is actuated on the return stroke of the ram to feed the strip of terminals to the left one position, ready for the next termination. The conductor is sometimes bent or positioned slightly out of alignment with the insertion tooling causing a defective termination or a jamming that reduces productivity and may result in damage to the tool. Various guide members have been utilized to align the conductor directly under the insertion blade. These guide members are usually carried by the ram or the insertion blade and must be fully retracted from the terminated terminal prior to feeding the next terminal into position. However, with a short stroke tool such as the present one that also uses the return stroke of the ram to effect the feeding, there is not sufficient ram travel to withdraw the guide members and effect the feeding.

What is needed is a guide member that effectively engages, moves the conductor into alignment, and confines the conductor there until termination and then quickly withdraws while leaving most of the return stroke within which to feed the next terminal into position.

SUMMARY OF THE INVENTION

A tool is disclosed for attaching individual conductors of a cable to respective terminals of a strip of terminals of an electrical connector. The tool includes a frame, a work surface within the frame, and a ram carrying insertion tooling arranged to undergo reciprocating motion along an axis within the frame toward and away from the work surface to effect termination of the conductors to the terminals. Means is provided for feeding and positioning each of the terminals of the connector in seriatim into insertion position on the work surface in alignment with the axis. A comb means is associated with the ram for engaging and moving the conductor to a position in alignment with both the insertion tooling and the terminal and for confining the conductor in that position until termination thereof.

DESCRIPTION OF THE PREFERRED EMBODIMENT

Figure 1:
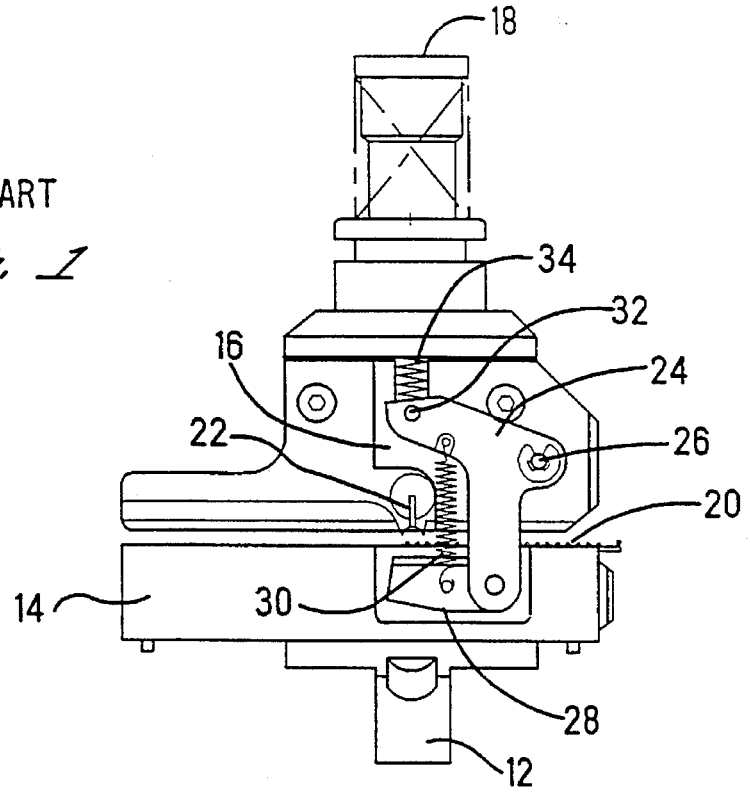
PRIOR ART Fig. 1
FIG. 1 is a front view of a prior art tool for terminating discrete wires to terminals of a connector.
Figure 3:
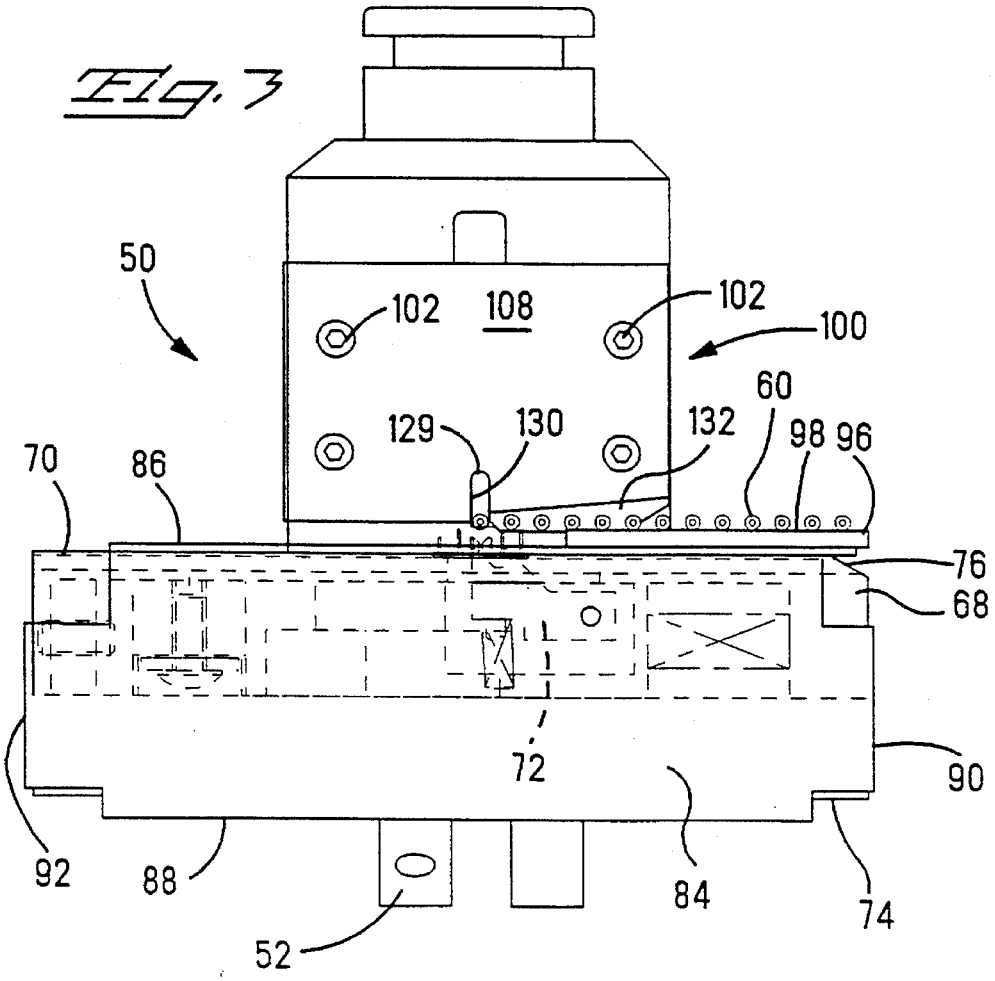
FIG. 3 is a front view of the tool shown in FIG. 2.
Figure 2:
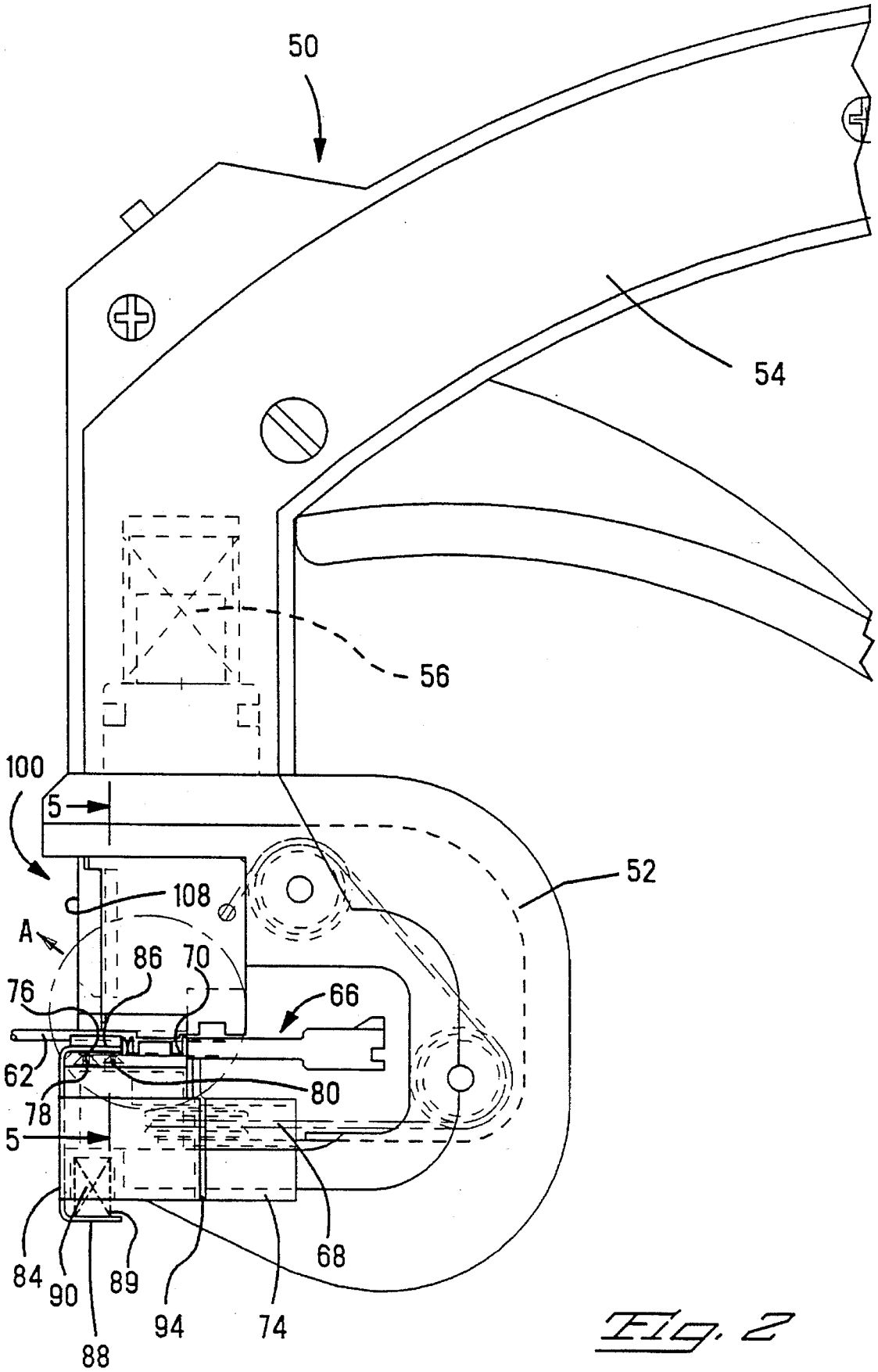
FIG. 2 is a side view of a tool for terminating conductors of a ribbon cable to terminals of a connector, incorporating the teachings of the present invention.
Figure 7:
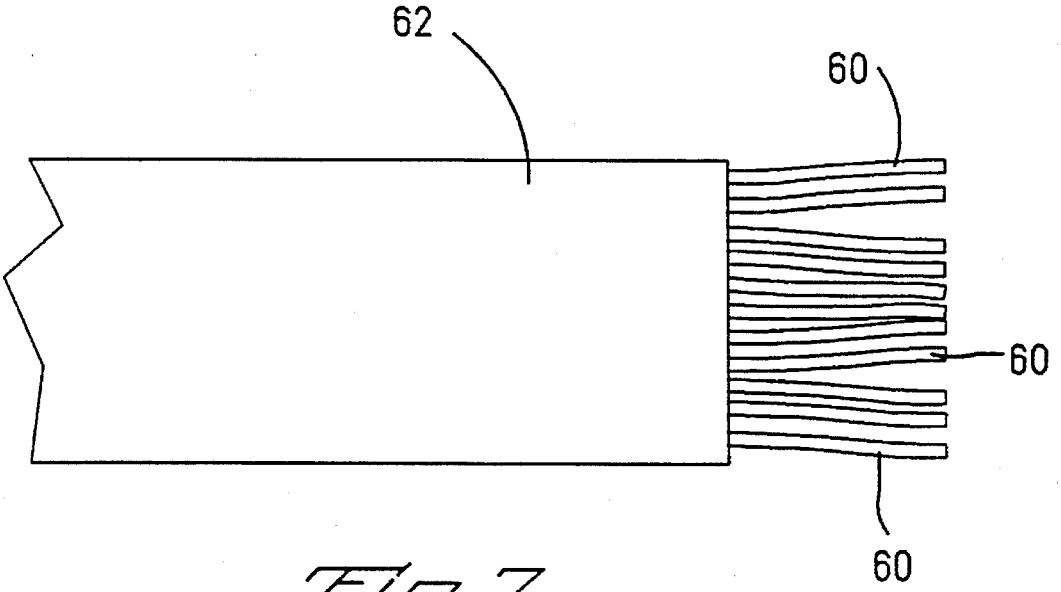
FIG. 7 is a plan view of a typical ribbon cable that is terminated with the present tool.
Figure 8:
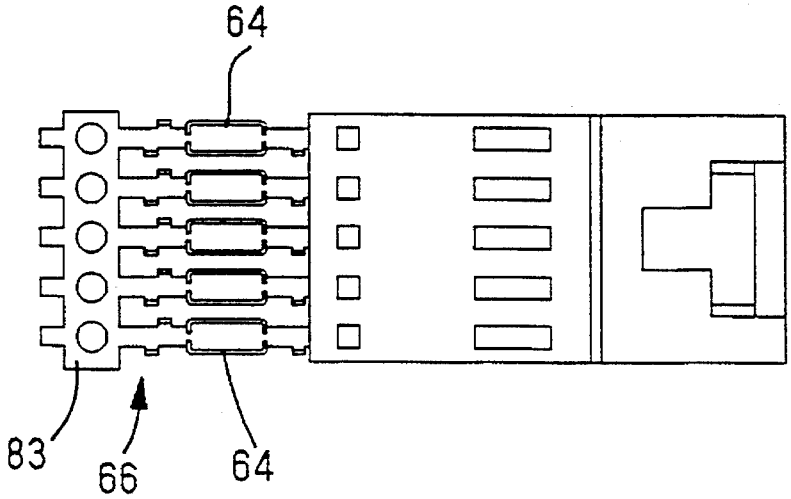

There is shown in FIGS. 2 and 3 a tool 50 having a frame 52 and, as best seen in FIG. 2, a pistol grip handle 54 for manual actuation of a ram 56. The tool 50 is used to terminate the conductors 60 of a ribbon cable 62, shown in FIG. 7, to terminals 64 of a connector 66, shown in FIGS. 8 and 9. A base plate 68 is secured to the frame by screws, not shown, and has a work surface 70 opposed to the ram 56. The ram 56 is arranged to undergo reciprocating motion toward and away from the work surface 70 during the terminating cycle. A terminal feed mechanism having a feed finger 72 is contained within a cavity in the base plate 68 and is arranged to incrementally feed the strip of terminals 64 and partially assembled connector housing of the connector 66 along a feed path on the work surface 70. It will be understood that, while this type of feed mechanism is disclosed, any suitable feed mechanism that is well known may be utilized in the practice of the present invention. A U-shaped bottom plate 74 is attached to the bottom of the baseplate 68 and is arranged to cover the cavity containing the feed finger 72.

Figure 9:
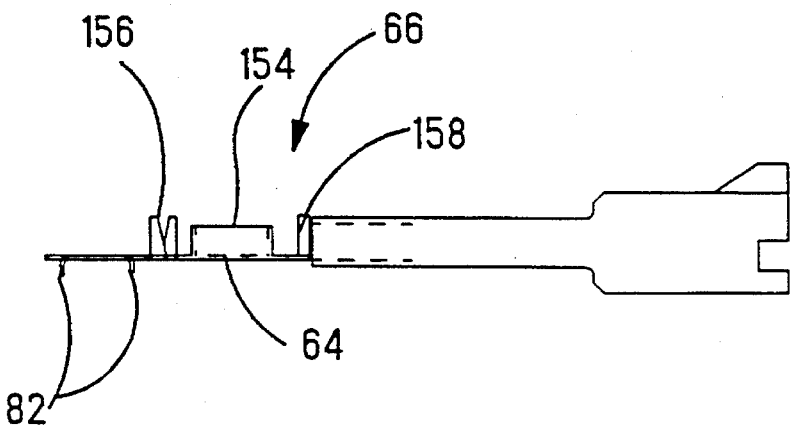
FIGS. 8 and 9 are plan and front views, respectively, of a partially assembled connector of the type terminated by the present tool.

The base plate 68, as best seen in FIG. 2, has a shoulder 76 rising from the work surface 70 a slight amount for the length of the work surface. A pair of slots 78 and 80 are formed in the work surface parallel with the shoulder 76 and with the direction of the feed and spaced apart an amount corresponding to the spacing of two rows 82 of tabs on a carrier strip 83 of the strip of terminals 64, as best seen in FIG. 9. The strip of terminals is placed on the work surface 70 so that the edge is in locating engagement with the shoulder 76 and the rows 82 of tabs are in the slots 78, 80, as shown in FIG. 2. The tabs in the slots 80 limit movement of the strip away from the shoulder 76.

A terminal strip drag 84 having a U-shaped cross section is arranged so that one leg 86 is directly above the carrier strip to which the terminals are attached and the other leg 88 is under a portion of the plate 74. Springs 89 are arranged between the bottom of the plate 74 and the leg 88 so that the springs 89 push against the leg 88 thereby causing the leg 86 to urge the carrier strip lightly against the strip of terminals on the work surface 70. The drag 84 is held in place by means of a pair of flanges 90 and 92 which extend from the two ends of the drag, along the sides of the plates 68 and 74, and then turn inwardly toward each other to engage a pair of slots 94 formed in the sides of the plates. The two flanges 90 and 92 are spaced to allow the drag to easily slide vertically, as viewed in FIGS. 2 and 3, while the slots 94 hold the drag 84 captive to the tool 50 and help to maintain the leg 86 parallel with the work surface 70, as viewed in FIGS. 2 and 3. By manually depressing the leg 88 to compress the springs 89, the other leg 86 is raised above the work surface 70 a sufficient amount so that the carrier strip of the strip of terminals 64 can be slid into place on the work surface and against the shoulder 76. The leg 88 is then released and the springs 89 urge the drag 84 downwardly against the carrier strip to provide resistance to movement of the strip of terminals 64 during operation of the tool 50. The drag 84 includes a spacer plate 96 attached to the top of the leg 86 having a raised surface 98 spaced above the work surface 70 a small amount so that it will receive and guide the ribbon cable 62 and space the ribbon cable from the strip of terminals until just prior to actual termination of each of the conductors 60.

Figure 4:
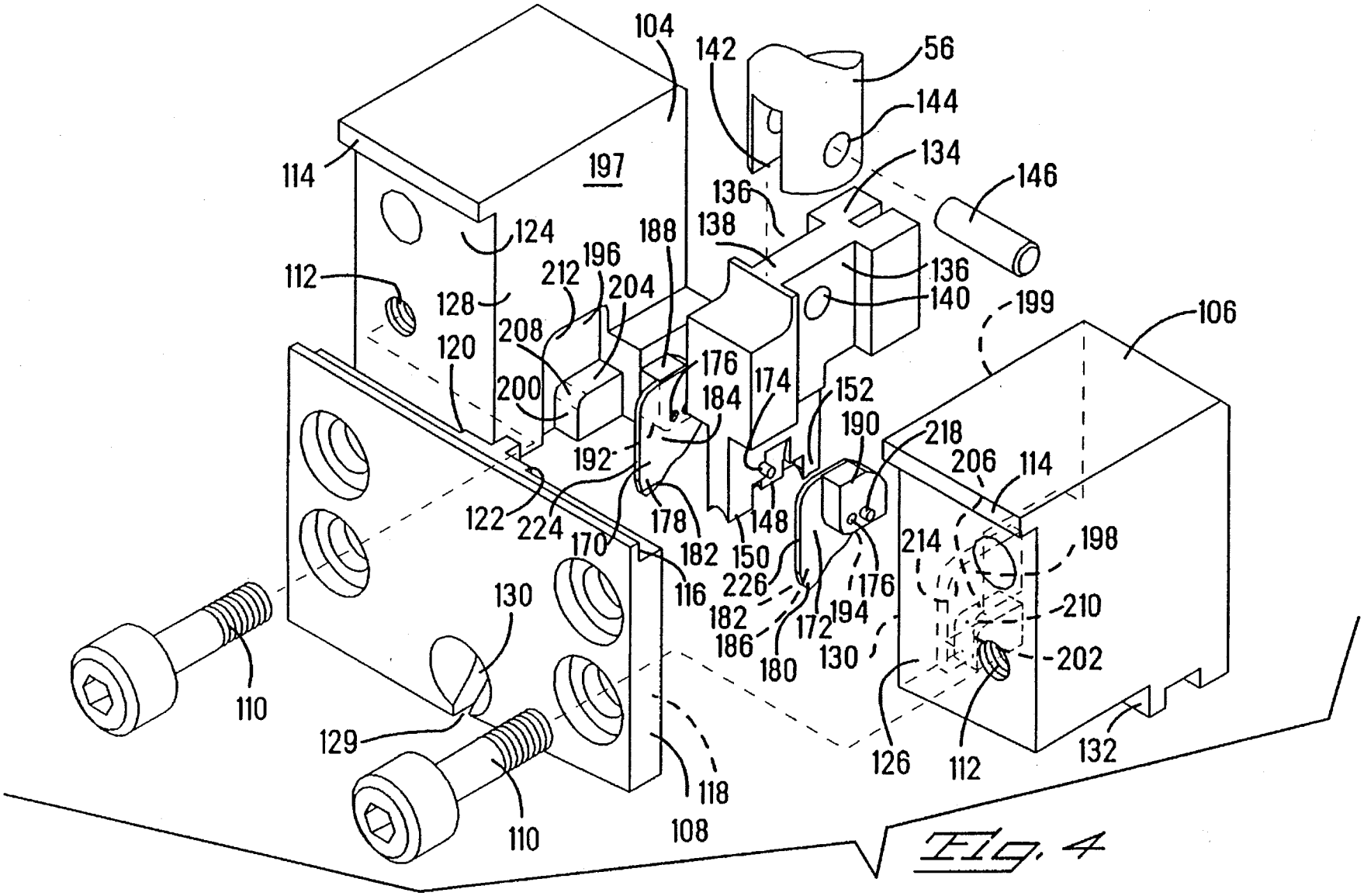
FIG. 4 is an isometric exploded view of the insertion tooling assembly of the tool shown in FIG. 2.
Figure 5:
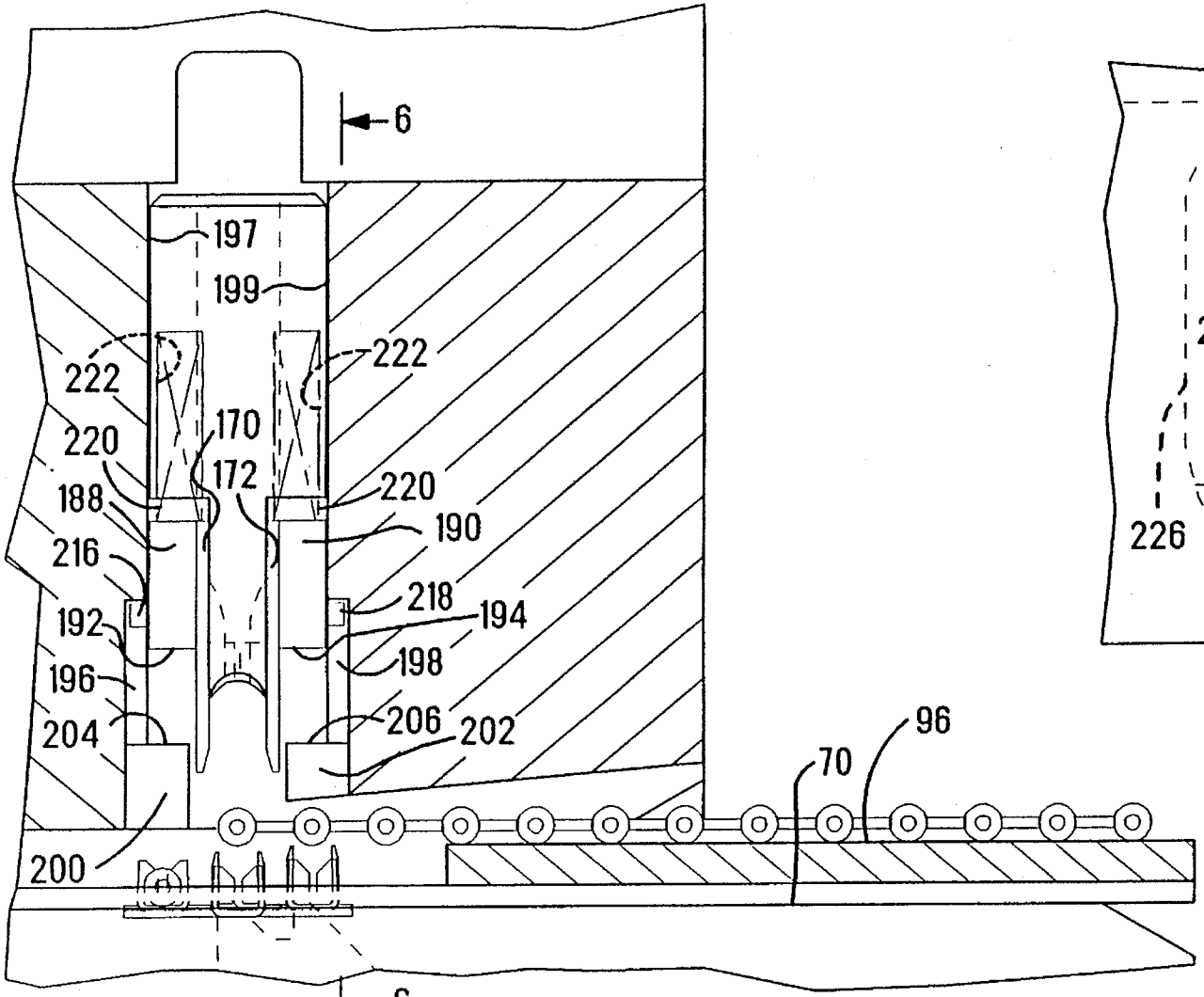
FIG. 5 a partial cross-sectional view taken along the line 5—5 in FIG. 2.

An insertion tooling assembly 100 is attached to the frame 52 by means of the two screws 102, as shown in FIG. 3. The tooling assembly 100 includes left and right wire guides 104 and 106, respectively and a wire stop plate 108, as best seen in FIG. 4, which is attached to the two wire stop plates by means of the screws 110 that are threaded into holes 112 in the wire guides. Each wire guide 104, 106 includes an overhanging top lip 114 that engages a rabbet 116 formed along the top edge of the wire stop plate 108. The wire stop plate 108 includes a mounting surface 118 having a central raised portion that defines left and right shoulders 120 and 122. When the wire stop plate 108 is attached to the wire guides 104 and 106, the surface 118 is against the surfaces 124 and 126 of the wire guides, the lips 114 are in engagement with the rabbet 116, and the surfaces 128 and 130 thereof are against the shoulders 120 and 122, respectively, of the stop plate 108. This serves to accurately locate the three parts and to hold them square during operation of the tool 50. A U-shaped opening 129 is formed in the wire stop plate 108 having a shoulder 130 which extends downwardly toward and very close to the plane of the raised surface 98, as best seen in FIG. 3, so that the first conductor 60 of the ribbon cable 62 can be located thereagainst. An additional locating surface 132 is formed on the under side of the right wire guide 106 and serves to limit the depth of insertion of the ribbon cable into the tool 50. With the end of the ribbon cable against the surface 132 and the first conductor 60 against the shoulder 130, the first conductor is in position for insertion into the first terminal 64 of the connector 66. As shown in FIGS. 4 and 5, an insertion bar 134 is disposed between the two surfaces 128 and 130 which are spaced to provide a loose slip fit with the insertion bar. The insertion bar 134 includes a cutout 136 on each side thereof thereby forming a neck 138, the neck having a through hole 140 formed therein. The ram 56 includes a cutout 142 that is sized to straddle the neck 138 and has a through hole 144 that aligns with the hole 140. A roll pin 146 extends through the holes 140 and 144 to attach the insertion bar to the end of the ram 56 so that the insertion bar reciprocates with the ram toward and away from the work surface. The insertion bar 134 includes an insertion blade 148 and two crimping die portions 150 and 152. The insertion blade 148 inserts the conductor 60 into an insulation displacement contact box 154 of the terminal 64, as best seen in FIG. 9, while the two die portions fold over a pair of lugs 156 to form a strain relief and a tab 158 which permits subsequent final insertion of the terminals into the housing of the connector 66.

Figure 6:
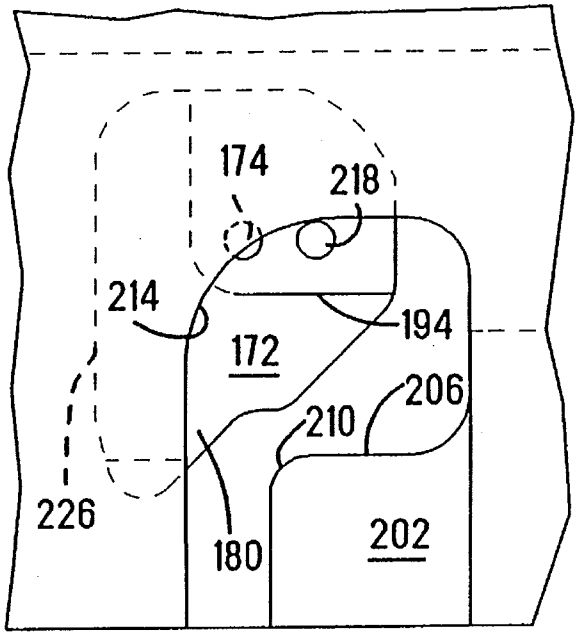
FIG. 6 is cross-sectional view taken along the lines 6—6 of FIG. 5.

A comb is carried by the insertion bar 134 and consists of a left support member 170 and a right support member 172 which are pivotally attached to opposite sides of the insertion bar by means of a pin 174 that is pressed into a hole in the insertion bar so that it extends outwardly from both sides. Each end of the pin 174 extends into slip fit holes 176 in each of the support members thereby permitting free pivotal movement of the support members 170 and 172. The two support members 170 and 172 have downwardly extending noses 178 and 180 with opposing chamfers 182, and substantially straight side portions 184 and 186, respectively. Further, the support members 170 and 172 include oppositely facing bosses 188 and 190 having downwardly facing surfaces 192 and 194, respectively, as best seen in FIGS. 4, 5, and 6. The two wire guides 104 and 106 include recesses 196 and 198 formed in opposing surfaces 197 and 199 and outwardly extending knees 200 and 202 having upwardly facing horizontal surfaces 204 and 206, respectively. The surfaces 204 and 206 terminate in downwardly directed radiuses 208 and 210. The top and front side walls of the two recesses 196 and 198 merge in radiuses 212 and 214, respectively which form cam tracks for a purpose that will be explained below. As shown in FIG. 5, the downwardly facing surfaces 192 and 194 are vertically above the upwardly facing surfaces 204 and 206, respectively, so that as the ram moves the insertion bar downwardly, these opposing surfaces will engage. The boss 188 has a pin 216 extending therefrom into the recess 196 and the boss 190 has a pin 218 extending therefrom in the opposite direction into the recess 198, as best seen in FIG. 5. The pins 216 and 218 serve as followers that track the cam track radiuses 212 and 214 to return the support members 170 and 172 to their starting positions on the return stroke of the ram 56, as will be explained below. As best seen in FIG. 5, a pair of drag springs 220 are disposed in blind holes 222 formed in the insertion bar 134 and are positioned directly over their respective support members 170, 172 so that they push against the top surfaces of the bosses 188 and 190. This causes a resistance to the pivotal movement of the support members thereby inhibiting such movement that may be caused by vibration or other forces acting on the mechanism.

The operation of the tool will now be described with reference to FIGS. 2 and 10 through 18. In operation, the leg 88 is manually depressed compressing the spring 89, the other leg 86 is thereby raised above the work surface 70 and the carrier strip 83 of a strip of terminals 64 slid into place on the work surface under the leg 86 and against the shoulder 76. The leg 88 is then released so that the spring 89 urges the drag 84 downwardly against the carrier strip 83 to hold the strip of terminals in place and to provide resistance to movement of the strip during operation of the tool 50. The strip of terminals is manually pushed along the locating shoulder until the strip engages the feed points of the feed finger 72, the operator then advances the first terminal 64 forward by cycling the ram 56 to place the terminal in proper position under the insertion bar 134. A prepared ribbon cable 62 is positioned on the raised surface 98, as shown in FIG. 3, with its left most insulated conductor against an edge 130 of the wire stop plate 108 so that the conductor is directly between the first terminal 64 and the insertion bar 134. The sheared end of the ribbon cable is urges against a rear stop surface 132 which serves to position the conductors axially as well as orient the ribbon cable perpendicular to the direction of feed. Note that the end of the ribbon cable was previously prepared by notching the insulation between the conductors so that each conductor end is separated from the others yet is surrounded by a layer of insulation. The notching process is well known in the industry.

Figure 11:
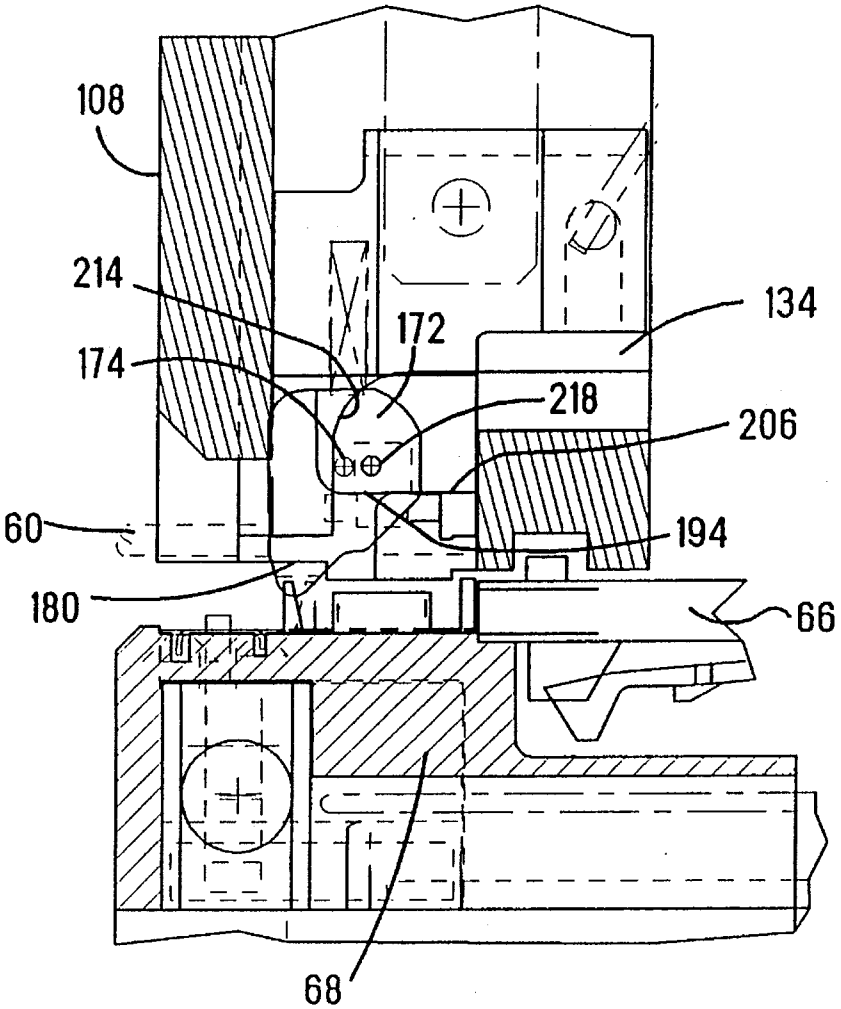
FIG. 10 through 18 are partial cross-sectional views taken from the area A shown in FIG. 2, showing the operation of the combing mechanism.
Figure 10:
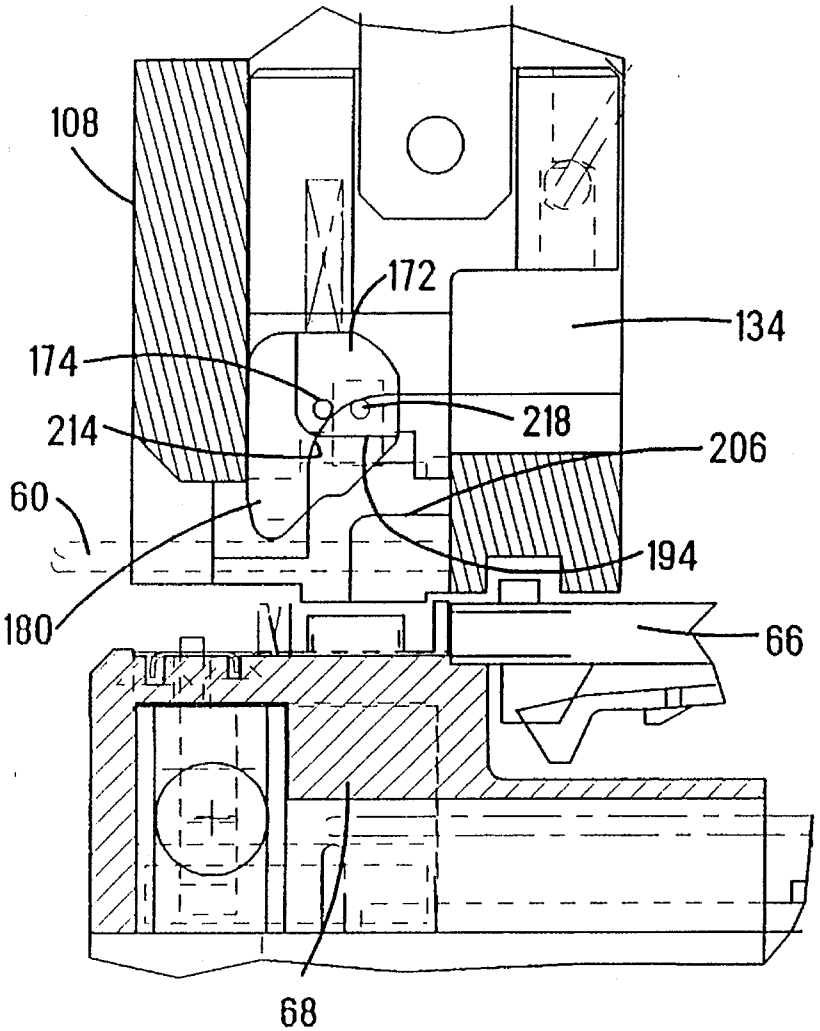
Figure 13:
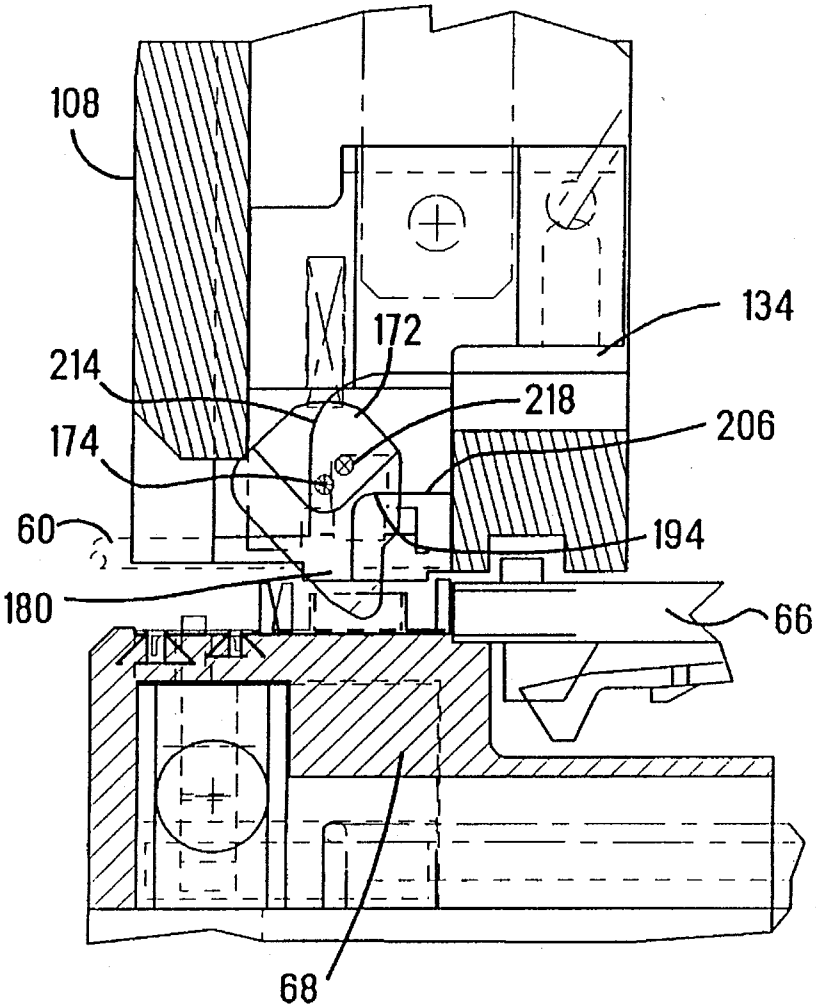
Figure 12:
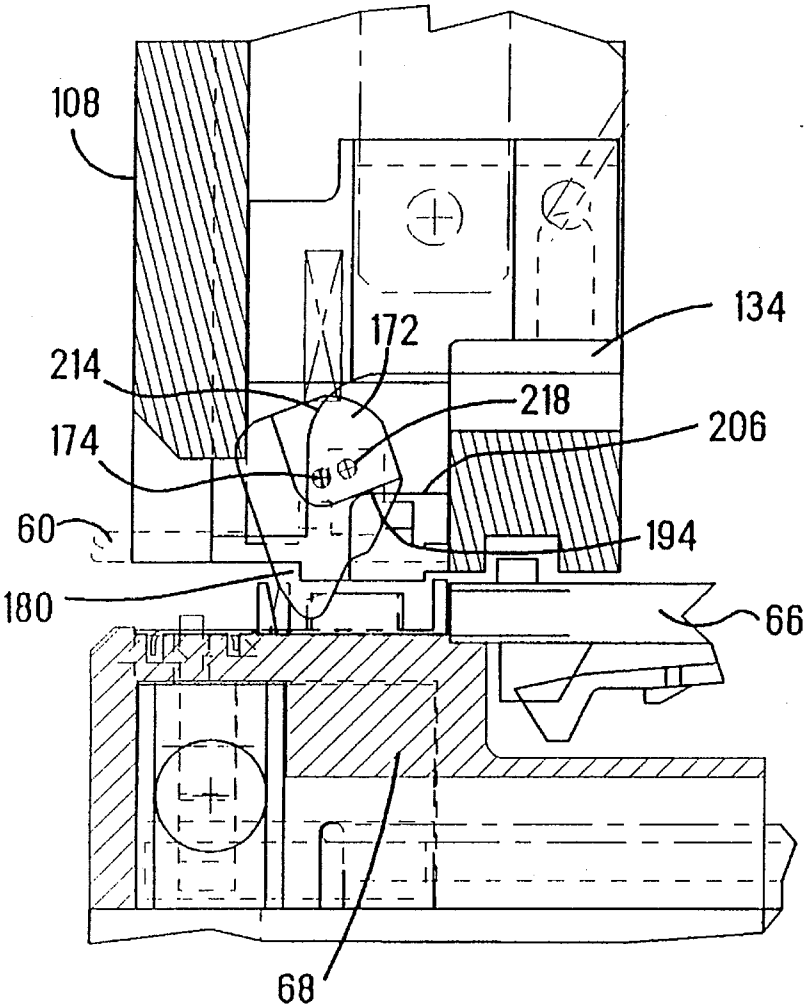
Figure 15:
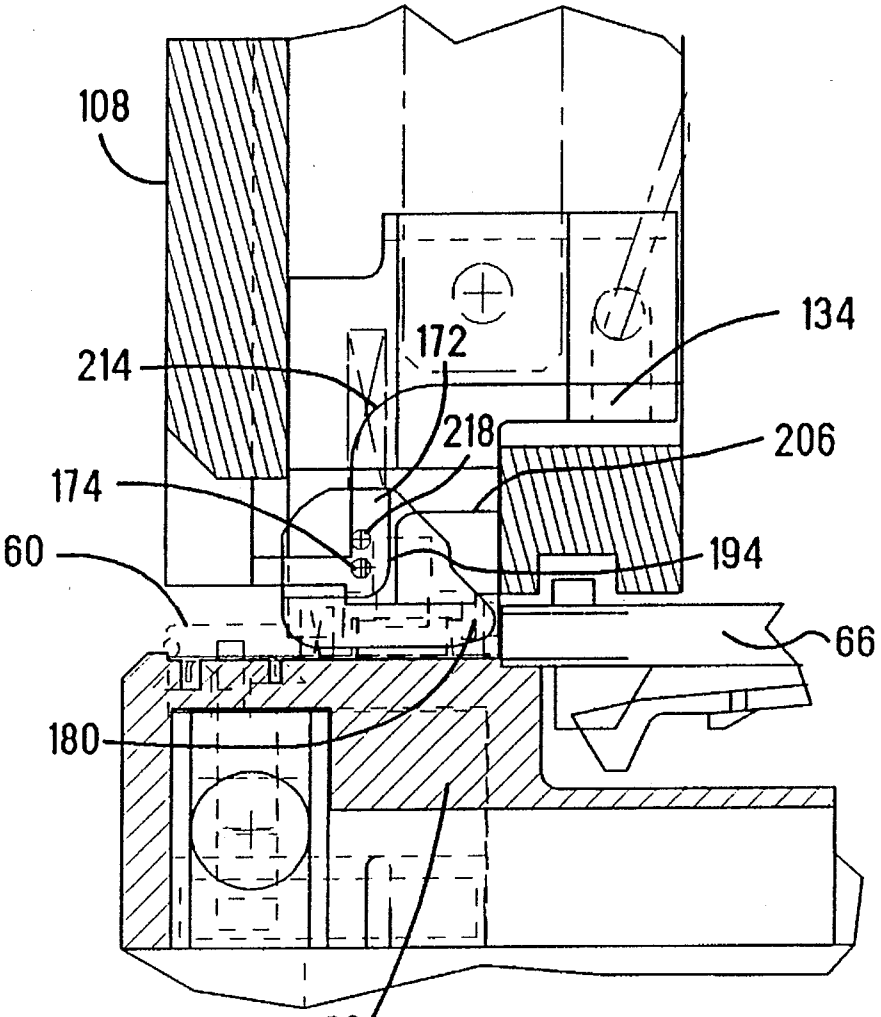
Figure 14:
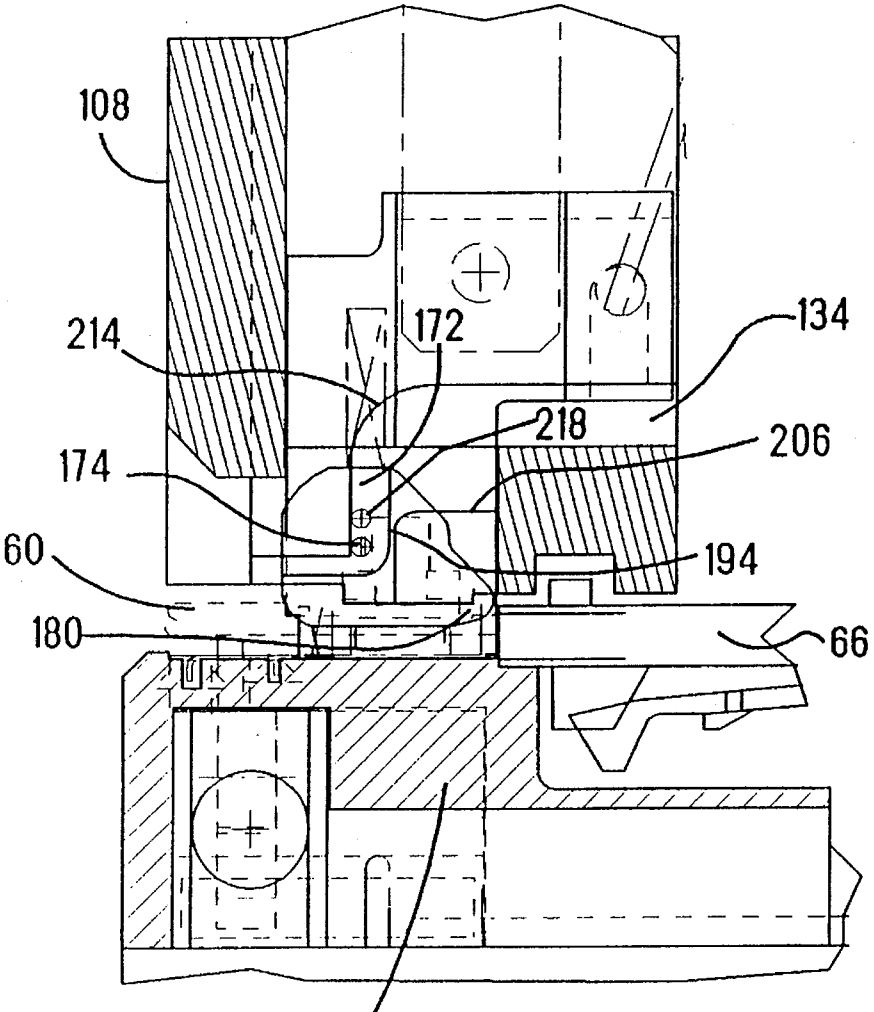
Figure 17:
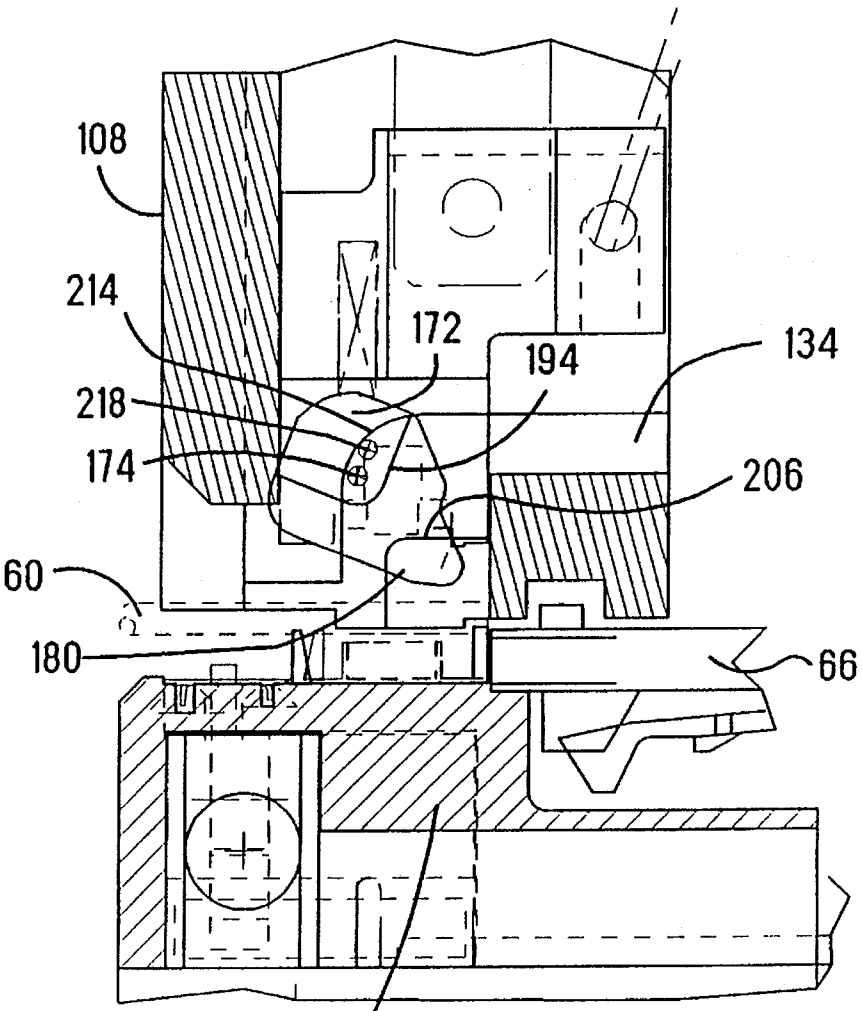
Figure 16:
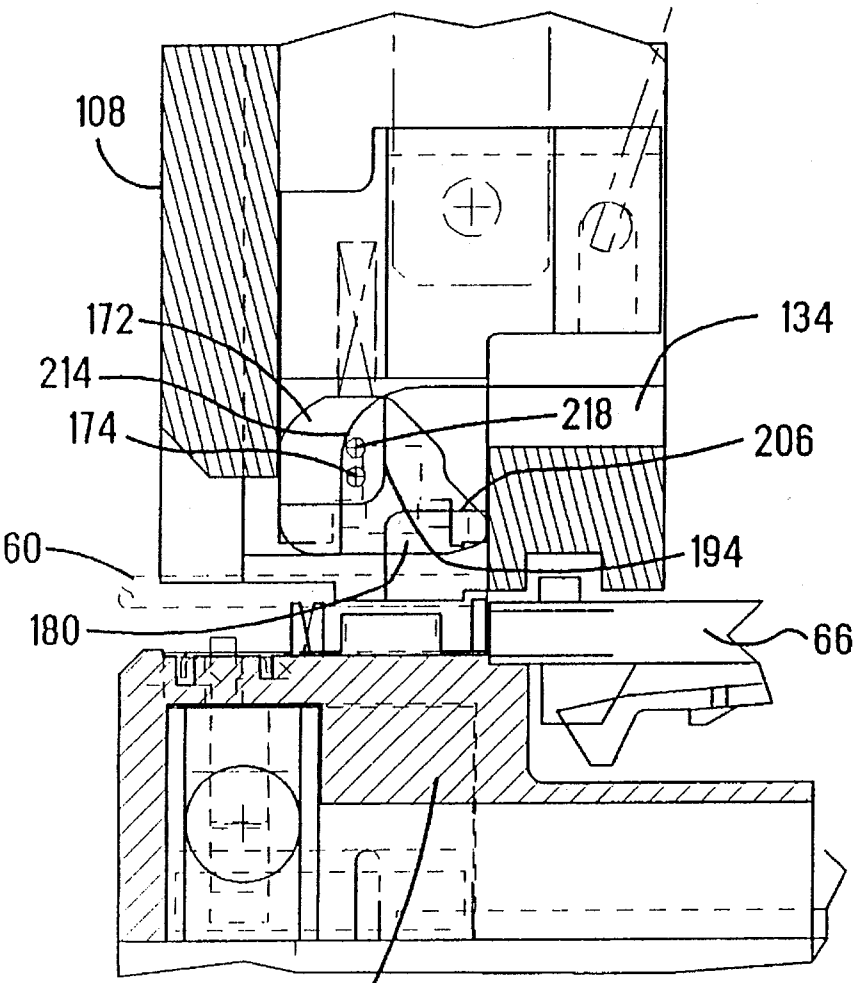
Figure 18:
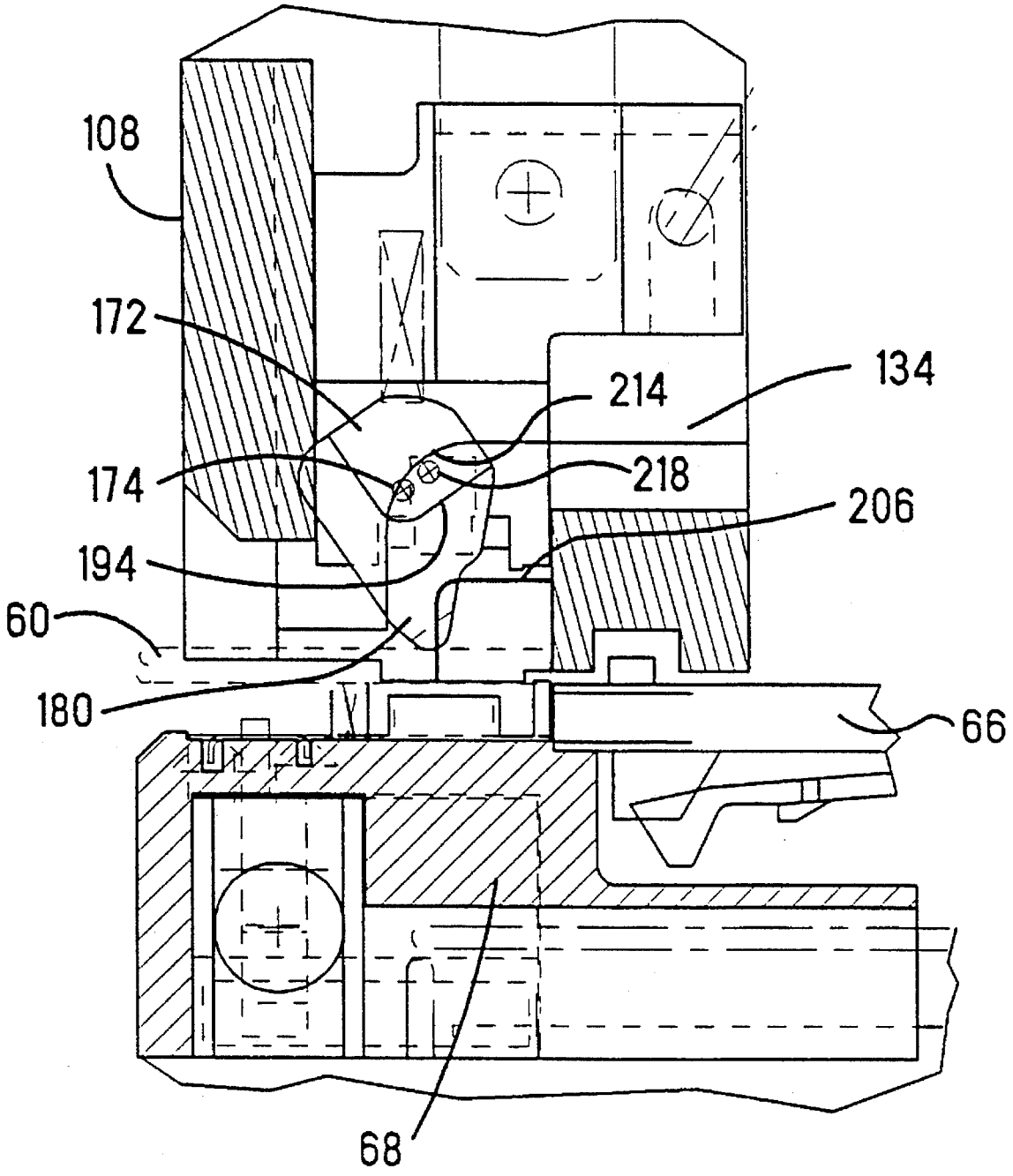

The ram 56 is then caused to move toward the work surface 70 by manually actuating the pistol grip handle 54, or the power actuator if utilized. As the ram 56 and attached insertion bar 134 move toward the work surface 70 from the starting position shown in FIGS. 5, 6, and 10, the noses 178 and 180 move to straddle the first conductor 60 by entering into the notches in the ribbon cable 62, as shown in FIG. 11. At this point in the cycle the surfaces 192 and 194 are in engagement with the surfaces 204 and 206. As downward movement of the ram 56 continues, as shown in FIGS. 12 and 13, the surfaces 192 and 194 roll about the radiuses 208 and 210 causing the support members 170 and 172 to pivot counterclockwise about the pin 174. As this occurs the noses 178 and 180 move to the right toward the end of the conductor, as viewed in FIGS. 12 and 13, yet maintain the conductor between the two support members 170 and 172. Note that this rolling movement of the surfaces 192, 194 over the radiuses 208, 210 is caused by the ram continues, the insertion bar 134 engages the conductor 60 as shown in FIG. 13, moves it toward the terminal 64 as shown in FIG. 14, and into the contact box 154, as shown in FIG. 15, where the lugs 156 and 158 are folded over. As the pivot pin 174 passes below the radius 210, the surfaces 192 and 194 of the support members 170 and 172 become substantially perpendicular to the surfaces 204 and 206, respectively, with the straight side portions 184 and 186 straddling and supporting the sides of the contact box 154 and their edges 224 and 226 substantially parallel with the work surface 70. During this pivoting of the two support members 170 and 180 provided a combing action to straighten the first conductor 60 and to confine it in position directly in alignment with both the terminal 64 and the insertion bar 134. As the ram 56 begins to move from the bottom of its downward stroke, as shown in FIG. 15, upwardly on its return stroke, as shown in FIG. 16, the two support members 170 and 172 move upwardly with the ram but their edges 224 and 226 remain substantially parallel with the work surface 70, held there by the springs 220, until they clear the terminal 64 and conductor. At this point the feed finger 72 is made to begin advancing the strip of terminals and ribbon cable toward the left, as viewed in FIG. 3, and the pins 216 and 218 begin to engage their respective radiuses 212 and 213, as shown in FIG. 16. As the ram continues to move upwardly on its return stroke, as shown in FIGS. 17 and 18, the pins 216 and 218 follow their respective radiuses 212 and 214, thereby pivoting the two support members clockwise until they reach their starting position as shown in FIG. 10. At this point the feed cycle has been completed and the strip of terminals 60 and the ribbon cable are positioned for termination of the next conductor in a similar manner.

It is important that the insertion bar 134 and the two support members 170 and 172 clear the terminated conductor and terminal as quickly as a possible on the return stroke of the ram to provide sufficient ram travel to feed the next conductor and terminal into position. This is accomplished by leaving the support members in their full counterclockwise positions until the ram 56 has withdrawn the small amount required for clearance. Then the support members are slowly rotated clockwise as the ram 56 is returned to its starting position and feeding of the ribbon cable and strip of terminals occurs. The above process continues until all of the conductors are terminated.

The cable 62 and attached connector 66 are then removed from the tool 50 by sliding them in the direction of feed until they are clear. The assembly is then visually examined to assure proper terminations. The strip of terminals is then fully inserted into the connector housing and the carrier strip broken off and discarded. While the tool 50, in the present example, is shown to terminate the conductors of ribbon cable to the terminals of a partially assembled connector, it can also be utilized to terminate discrete wires to these terminals. In this case the strip of terminals 64 and attached connector housing are loaded into the tool 50 as set forth above. The first wire is then inserted into the U-shaped slot 129 in the stop plate 108 so that its end is against the rear stop surface 132. The tool is then cycled to terminate the conductor and advance the strip of terminates so that the next terminal is in position under the insertion bar 134. Each discrete wire is terminated in this way until all wires are terminated.

An important advantage of the present invention is that the conductor is automatically combed into a straightened position in alignment with the terminal and insertion bar and confined in this position until termination is complete. Additionally, the combing mechanism permits quick withdrawal to provide sufficient return stroke travel of the ram to accomplish feeding of the cable and connector to the next position. During insertion of the conductor into the contact box, the two support members straddle and support the sides of the contact box, thereby helping to assure a high quality termination. The combing mechanism is relatively simple and inexpensive to manufacture, requiring no linkages. toggles, or other complex actuating mechanisms.

I claim:

1. In a tool for attaching individual conductors of a cable to respective terminals of a strip of terminals of an electrical connector wherein said tool includes a frame, a work surface within said frame, a ram carrying insertion tooling arranged to undergo reciprocating motion along an axis within said frame toward and away from said work surface to effect said attaching of said conductors to said terminals, means for feeding and positioning each of said terminals of said connector in seriatim into insertion position on said work surface in alignment with said axis, comb means associated with said ram for engaging and moving one of said conductors to a position in alignment between said insertion tooling and one of said terminals and confining said one conductor in said position of alignment until termination thereof, said comb means including a right support member and a left support member that straddle and closely confine said conductor on opposite sides thereof transverse to said ram axis so as to effect said engaging, moving, and confining only during movement of said ram toward said work surface.

2. The tool according to claim 1 wherein each said conductor has an end, and wherein said comb means begins to effect said engaging, moving, and confining of said conductor at a first point away from said end and then extends said engaging, moving, and confining toward said end.

3. The tool according to claim 2 wherein said insertion tooling includes an insertion blade that engages said conductor and inserts it into said terminal and wherein said left support member and said right support member are pivotally arranged on opposite sides of said insertion blade so that when said insertion blade moves from an initial position toward said work surface to a final position said support members pivot in a first direction and when said insertion blade moves away from said work surface back to said initial position said support members pivot in a second direction.

4. The tool according to claim 3 wherein said support members are pivotally attached to said insertion blade, each support member having a nose that extends toward said work surface when said insertion blade is in said initial position and arranged so that as said insertion blade moves toward said final position said noses of said support members straddle said conductor.

5. The tool according to claim 4 wherein each said support member includes a support surface adjacent said nose, said support surfaces being mutually opposed and arranged so that as said support members pivot in said first direction said mutually opposed support surfaces move into position on opposite sides of said conductor thereby effecting said confining of said conductor beginning at said first point and gradually extending said confining to substantially said end of said conductor.

6. The tool according to claim 5 including an upwardly facing surface and a cam track, both of which are fixed with respect to said frame, wherein said comb means includes a camming surface in opposed relation with said upwardly facing surface and a follower, both said camming surface and follower arranged so that:

as said insertion blade moves toward said work surface said camming surface engages said upwardly facing surface thereby causing said support members to pivot in said first direction and as said insertion blade moves away from said work surface said support members move out of said confining position and then said follower engages said cam track thereby causing said support members to pivot in said second direction, whereby the support members clear the terminated terminal so that feeding of the next terminal into position can begin prior to pivotal movement in the second direction.

7. The tool according to claim 5 including a first upwardly facing surface adjacent said first support member and a second upwardly facing a surface adjacent said second support member, said first and second upwardly facing surfaces being fixed with respect to said frame, wherein said first support member includes a first camming surface in opposing relation with said first upwardly facing surface and said second support member includes a second camming surface in opposing relation with said second upwardly facing surface, and wherein said pivotal attachment of said support members is offset from said upwardly facing surfaces so that when said insertion blade moves toward said work surface said first and second camming surfaces engage their respective first and second upwardly facing surfaces and cause said support members to pivot in said first direction.

8. The tool according to claim 7 including a first cam track adjacent said first support member and a second cam track adjacent said second support member, said first and second cam tracks being fixed with respect to said frame, wherein said first and second support members include first and second followers, respectively, that engage said first and second cam tracks, respectively when said insertion blade moves from said final position to said initial position, thereby causing said support members to pivot in said second direction.

9. The tool according to claim 8 wherein said upwardly facing surfaces and said cam tracks are further arranged so that as said insertion blade moves toward said work surface said camming surfaces engage their respective said upwardly facing surfaces thereby causing said support members to pivot in said first direction and as said insertion blade moves away from said work surface said support members move out of said engaging and confining position and then said followers engage their respective said cam tracks thereby causing said support members to pivot in said second direction, whereby the support members clear the terminated terminal so that feeding of the next terminal into position can begin prior to pivotal movement in the second direction.

* * * * *